US005842958A

United States Patent [19]

Rufa

[11] Patent Number: 5,842,958

[45] Date of Patent: Dec. 1, 1998

[54] ARM WRESTLING DEVICE

[76] Inventor: Fernando P. Rufa, 1721 County Rte. 49, Winthrop, N.Y. 13697

[21] Appl. No.: 884,570

[22] Filed: Jun. 27, 1997

[51] Int. Cl.[6] ..... A63B 21/008; A63B 69/00; A63B 21/00

[52] U.S. Cl. ..... 482/112; 482/905; 482/901; 463/7; 273/452; 434/247

[58] Field of Search ..... 482/113, 112, 482/121, 122, 123, 901, 902, 905; 434/247; 463/7; 273/452, 451

[56] References Cited

U.S. PATENT DOCUMENTS

| | | | |
|---|---|---|---|
| 496,094 | 4/1893 | Peloquin . | |
| 929,281 | 7/1909 | Brodeur . | |
| 948,140 | 2/1910 | Johnson . | |
| 3,400,793 | 9/1968 | Norris | 273/452 X |
| 3,559,487 | 2/1971 | Parlato . | |
| 3,662,602 | 5/1972 | Weiss . | |
| 3,938,389 | 2/1976 | Kella . | |
| 4,129,297 | 12/1978 | Dolan | 482/123 |
| 4,209,167 | 6/1980 | Jansen . | |
| 4,406,454 | 9/1983 | Dean | 482/905 X |
| 4,482,149 | 11/1984 | Weldon | 482/905 X |
| 4,509,747 | 4/1985 | Martin | 482/905 |
| 4,542,897 | 9/1985 | Melton | 463/7 |
| 4,771,344 | 9/1988 | Fallacaro | 434/247 X |
| 4,805,900 | 2/1989 | Sapp | 482/121 X |
| 4,811,944 | 3/1989 | Hoff | 482/130 |
| 5,431,616 | 7/1995 | Centofante | 482/123 |
| 5,466,200 | 11/1995 | Ulrich | 482/901 X |
| 5,591,104 | 1/1997 | Andrus | 482/901 X |

*Primary Examiner*—Richard J. Apley
*Assistant Examiner*—William LaMarca
*Attorney, Agent, or Firm*—Terrance L. Siemens

[57] ABSTRACT

Arm wrestling apparatus employing two opposed hydraulic dampers to provide resistance. The apparatus has a base and a lever pivotally mounted to the base. Hydraulic circuitry of the dampers may be controlled to vary resistance, and is employed to operate a gauge indicating force of effort. In an alternative embodiment of the invention, two novel arm wrestling devices are employed remotely from one another. Each device is provided with a video display. Radio, telephone or other links connect the displays of the two arm wrestling devices so that observers at either location may monitor a competition between two persons, one at each location.

2 Claims, 2 Drawing Sheets

ARM WRESTLING DEVICE

BACKGROUND OF THE INVENTION

1. Field of the Invention

The present invention relates to sports apparatus, and more particularly to a mechanical device which one may employ to engage in arm wrestling. The device includes a lever which is grasped by hand, resistance apparatus opposing effort exerted by the user, and a base for supporting the novel device on a horizontal surface.

2. Description of the Prior Art

Mechanical apparatus for replacing one of two persons engaged in arm wrestling contests is well known. This type of apparatus may be employed in the absence of a suitable adversary in competitions, or utilized to provide a quantitative indication of effort which one can exert. Most prior art devices of this type employ springs for resistance, and many have gauges for displaying effort. Examples include U.S. Pat. No. 3,662,602, issued to Marcel Weiss on May 16, 1972, and U.S. Pat. No. 4,209,167, issued to Patrick W. Jansen on Jun. 24, 1980. Both of these devices allow for adjustment of force of resistance. However, unlike the present invention, these devices cannot be employed bidirectionally without adjustment. Neither device employs hydraulic damping for resistance, and neither device is linked to a remotely located similar device, as seen in the present invention.

U.S. Pat. No. 3,559,457, issued to Frank Parlato on Feb. 2, 1971, describes an arm wrestling device utilizing resistance of a resilient cord. Unlike the present invention, the device of Parlato does not indicate effort exerted, lacks hydraulic damping, and is not linked to a remotely located similar device.

None of the above inventions and patents, taken either singly or in combination, is seen to describe the instant invention as claimed.

SUMMARY OF THE INVENTION

The present invention provides an arm wrestling device having opposed hydraulic dampers. The hydraulic circuitry of the dampers can be adjusted to vary resistance of the damper to compressive forces applied by the user. The hydraulic circuitry also operates a gauge indicating force of effort.

Structure of the invention includes a base, an upright lever pivotally mounted on the base, and two hydraulic dampers. Each damper is pivotally anchored at its respective proximal end to the lever, and at its respective distal end to the base. The novel arm wrestling device is thus bilaterally symmetrical when viewed from the side. An advantage from this arrangement is that the device is readily employed by both right and left handed users without disassembly of or rearrangement to the apparatus or its component parts.

In one embodiment of the invention, two different, remotely located arm wrestling devices are communicably linked by radio frequency, telephone connection, or in any other suitable way. Each device has a display displaying effort exerted by both devices. This enables contests to be conducted pitting remotely located contestants against one another. Each contestant and onlookers at both sites can monitor the competition. A winner is immediately determined and known to all observers despite intervening distance.

The displays may further be augmented by cameras and video links enabling observers at each location to view the distant competitor.

Accordingly, it is a principal object of the invention to provide an arm wrestling device utilizing hydraulic resistance to muscular effort exerted by a user.

It is another object of the invention that the arm wrestling device be adjustable as to resistance to muscular effort exerted by a user.

It is a further object of the invention to provide a gauge or display indicating force of muscular effort exerted by a user.

Still another object of the invention is that the arm wrestling device be readily employed in both right and left handed fashion without requiring disassembly or rearrangement of its component parts.

An additional object of the invention is to enable communicable linkage of the respective displays of two novel arm wrestling devices remotely located from one another, so that both results may be monitored by observers located proximate either device.

It is again an object of the invention to provide a video link and video display enabling viewing of the distant competitor by observers at one or both locations.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
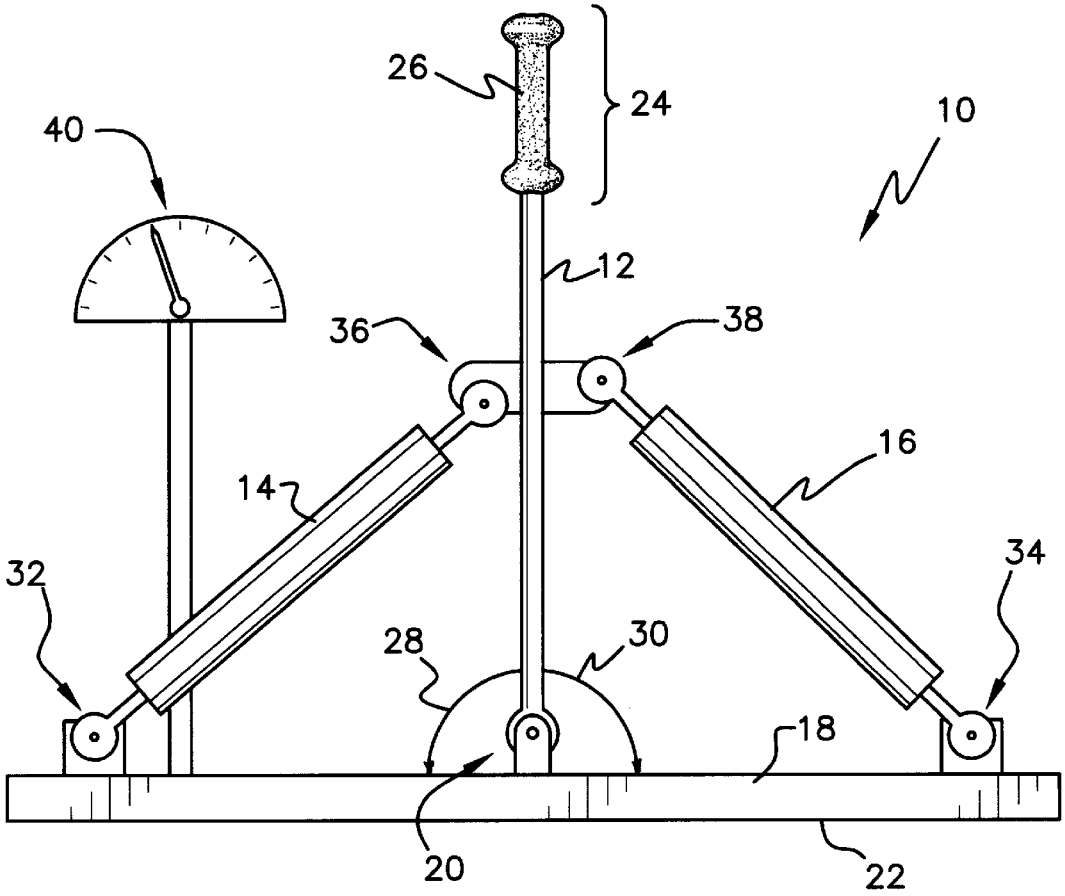
FIG. 1 is a front elevational view of one novel arm wrestling device.

FIG. 1 of the drawings shows one novel arm wrestling device 10. Device 10 is employed by a single person, who grasps arm 12 by hand. Device 10 and the elbow of the user are placed on a tabletop (not shown) or other horizontal support surface. The user attempts to force arm 12 to a position as close to horizontal as is allowed by hydraulic damper 14 or 16. In short, device 10 replaces one of two people conventionally engaging in arm wrestling. The motion of one arm is essentially duplicated by arm 12 of device 10.

The proximal end of arm 12 is pivotally fixed to base 18 at the axle (not separately shown) of a clevis 20. Base 18 preferably has a flat bottom surface 22, so that it may engage the table or other supporting surface. The distal section 24 of arm 12 has a grip 26 or other structure providing a handle for grasping and applying muscular effort to arm 12. Distal section 24 is unencumbered by attachments and structure other than grip 26 or other handle structure, to avoid interference with operation of device 10.

Resistance conventionally provided by an adversary is provided in the present invention by either one of dampers 14, 16. Each damper 14 or 16 is essentially has mirror image construction relative to the other. Each damper 14 or 16 has internal hydraulic circuitry of well known nature providing a restriction to fluid flowing when the respective damper 14 or 16 is compressed, or urged into a collapsed or shorter configuration. As employed herein, circuitry will encompass all necessary receptacles, conduits, fittings, and fluid required for operability.

Dampers 14, 16 are depicted as resisting compression by fluid resistance while only nominally opposing extension. However, it would be equally feasible to arrange hydraulic circuitry to oppose expansion and allow compression to similar effect, since when arm 12 is moved in the direction of either arrow 28 or 30, one damper 14 or 16 is compressed and the other damper 14 or 16 is extended. The term "extensible" will be understood to encompass both arrangements.

Each damper 14 or 16 has a proximal end mounted to base 12 at a clevis arrangement 32 or 34 similar to that of clevis 20. The distal end of each damper 14 or 16 is similarly mounted to arm 12 at a clevis 36 or 38. Dampers 14, 16 are disposed to expand and compress in directions different from one another. These directions are preferably, but not necessarily, opposed.

Hydraulic circuitry of dampers 14, 16 is preferably extended to a display, such as gauge 40, for displaying force imposed upon the damper 14 or 16 exerting resistance to compression. This type of gauge and related modification to hydraulic circuitry for translating fore imposed upon the resisting extensible damper 14 or 16 into a form usable by gauge 40 or an equivalent display are well known and need not be set forth in detail herein.

Figure 2:
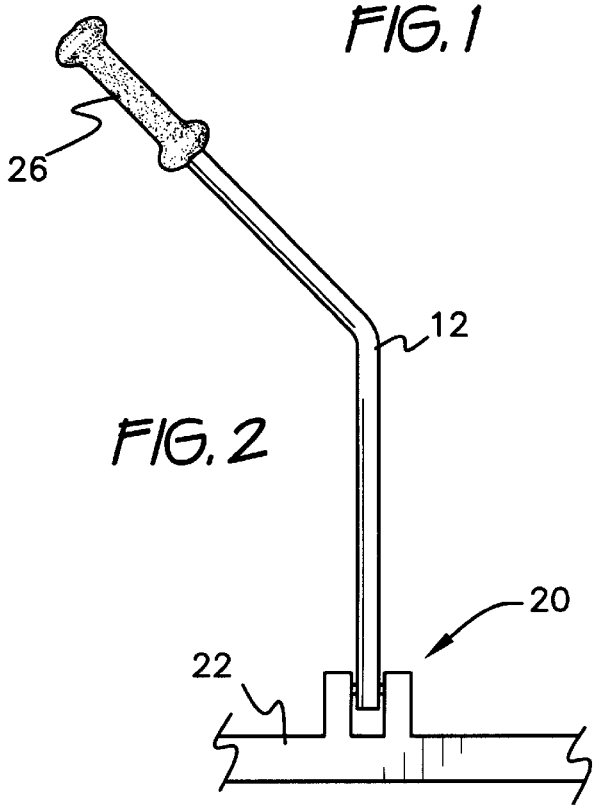
FIG. 2 is a side elevational detail view taken from FIG. 1, illustrating offset of the handle.

As shown in FIG. 2, arm 12 is offset, or bent such that distal section 24 inclines away from gauge 40. Although this feature avoids interference of the user with gauge 40 or other structure which may be arranged to occupy space adjacent arm 40, it also enables grasping of arm 12 in a manner essentially similar to engagement of a human adversary's hand in an arm wrestling contest.

Figure 3:
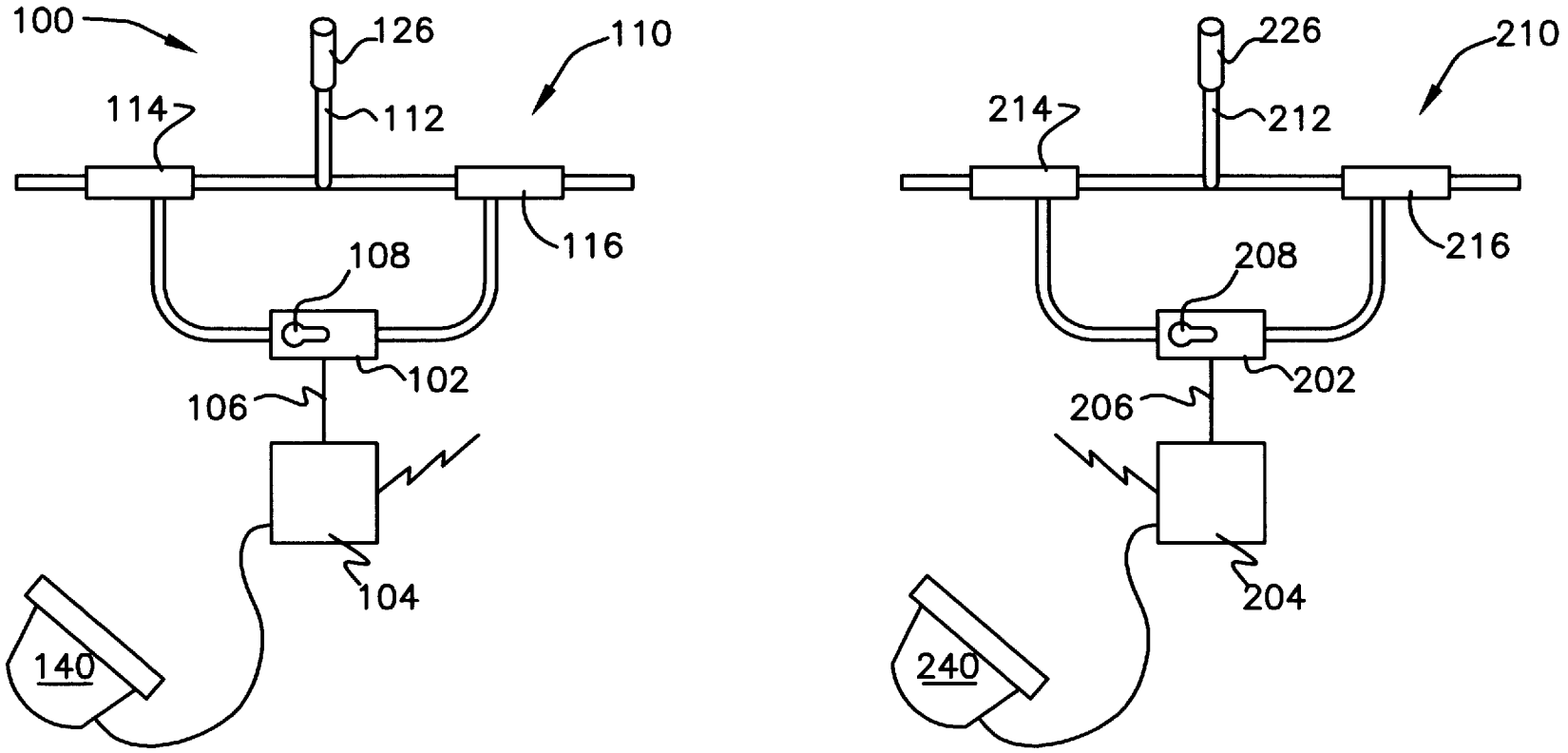
FIG. 3 is a diagrammatic, top plan view of an alternative embodiment of the invention, wherein two novel remotely located, communicably linked arm wrestling devices are provided, each having a video camera and video display.

Turning now to FIG. 3, in a preferred application of arm wrestling invention of FIG. 1, two arm wrestling devices 110, 210 are paired or linked as part of one apparatus 100, each device 110 or 210 accommodating a different user. Apparatus 100 is intended to enable remotely located competitors to overcome intervening distance and compete in arm wrestling indirectly against one another, although participants may be located in close proximity to one another. Each participant utilizes one arm wrestling device 110 or 210, and comparative respective efforts are displayed for the participants and observers to see.

Each device 110 or 210 has construction of effort resisting components essentially repeating construction of device 10 of FIG. 1, and function is correspondingly similar. Hence corresponding parts of the devices 110, 210 are labeled with reference numerals differing only in the first digit, the final two digits being similar to one another and similar to corresponding components of device 10 of FIG. 1. Although both devices 110, 210 may each employ a gauge (not shown), it is preferable that each device 110, 210 have a video display, such as a cathode ray tube operated screen 140 or 240 (respectively). Screens 140, 240 are provided with signals enabling each device 110 or 210 to display both results of its associated device 110 or 210 and also events occurring at the other device 210 or 110.

Each device 110 or 210 has a base and pivotal connections corresponding to clevis arrangements 20, 32, 34, 36, and 38 of FIG. 1, these being omitted from FIG. 3 for clarity. Description will proceed regarding one device 110, it being understood that device 210 has similar corresponding features. Arm wrestling device 110 has a hydraulic transducer 102 connected to the hydraulic circuitry of dampers 114, 116. Transducer 102 provides a signal connected to a video communication device 104 by conductor 106. Communication device 104 provides a video signal to CRT screen 140. Communication device 104 also has radio frequency transmitter and receiver (not separately shown) for communicably linking with communication device 204 of corresponding device 210. Communication devices 104, 204 are able to transmit signals to one another and to receive signals from one another.

Alternatively, communication devices 104, 204 may comprise telephone apparatus (not shown), including cord and plug (not shown) for connecting to telephone receptacles (not shown). Telephone apparatus, if provided, may include low powered radio communication apparatus, as employed in cordless telephones. Regardless of the nature of the communications link, it is merely necessary that video signals be transmitted between and received by communication devices 104, 204 in any suitable known way. By this arrangement, progress of both participants in an arm wrestling contest may be monitored on both screens 140, 240. Preferably, communication devices 104, 204 are arranged such that similar subject matter is visible simultaneously on both screens 140, 240. Alternatively, the results from any one device 110 or 210 are displayed upon screens 140, 240.

Hydraulic circuitry of arm wrestling devices 110, 210 further comprises a valve 108 or 208 or the like for adjusting resistance of their respective dampers 114, 116, 214, 216 to force imposed thereon. The same modification can be incorporated into the embodiment of FIG. 1. Adjustment valve 108 or 208 may be located at any desired point in the hydraulic circuitry.

The present invention is susceptible to variations and modifications which may be introduced without departing from the inventive concept. By way of illustration, arm 12 may be movably mounted to base 18 by apparatus other than clevis 20. For example, a ball and socket joint (not shown) may be provided to enable more universal motion than that enabled by the axle of clevis 20.

Hydraulic circuitry may employ gasses rather than liquids, or gasses in combination with liquids, as desired.

The nature of the display, the exact orientation of dampers 14 and 16, 114 and 116, and 214 and 216 relative to one another, and configuration of arm 12, 112, or 212 may be varied to suit.

It is to be understood that the present invention is not limited to the embodiments described above, but encompasses any and all embodiments within the scope of the following claims.

I claim:

1. Apparatus for enabling remotely located opponents to engage in an arm wrestling contest, comprising:

a first arm wrestling device having a base, an arm having a proximal end movably mounted to said base and a distal section having a handle for enabling a user to grasp said arm and apply muscular effort to said arm, said distal section unencumbered by attachments and structure other than said handle, a first extensible damper having a first fluid circuit for resisting extension of said first extensible damper in one direction, said first extensible damper having a proximal end mounted to said base and a distal end mounted to said arm, an adjustment valve disposed in fluid communication with said first extensible damper, a transducer disposed to provide a signal, said transducer connected to said first fluid circuit, said first fluid circuit consisting of said first extensible damper, said adjustment valve, said transducer, and conduits establishing fluid communication among said first extensible damper, said adjustment valve, and said transducer, a second extensible damper disposed in fluid communication with said transducer and said adjustment valve, said second extensible damper having a second fluid circuit for resisting extension of said second extensible damper in one direction, said second extensible damper having a proximal end mounted to said base and a distal end mounted to said arm, wherein said first extensible damper is disposed in one direction and said second extensible damper is disposed in a different direction, a first display for displaying force imposed upon said first extensible damper, and means for translating force imposed upon said first extensible damper into a form usable by said first display, wherein said first display includes second means for translating force imposed upon said second extensible damper into a form usable by said first display;

a second arm wrestling device having a second base, a second arm having a proximal end movably mounted to said second base and a distal section having a second handle for enabling a user to grasp and apply muscular effort to said second arm, said distal section unencumbered by attachments and structure other than said second handle, a third extensible damper having a third fluid circuit for resisting extension of said third extensible damper in one direction, a fourth extensible damper having a fourth fluid circuit for resisting extension of said fourth extensible damper in a second direction, a second adjustment valve disposed in fluid communication with said third extensible damper and said fourth extensible damper, and a second transducer disposed to provide a signal, said transducer connected to said third fluid circuit and said fourth fluid circuit, said third fluid circuit and said fourth fluid circuit collectively consisting of said third extensible damper, said fourth extensible damper, said second adjustment valve, said second transducer, and conduits establishing fluid communication among said third extensible damper, said fourth extensible damper, said second adjustment valve, and said second transducer, a second display for displaying force imposed upon said third extensible damper and said fourth extensible damper, and means for translating force imposed upon said third extensible damper and said fourth extensible damper of said second arm wrestling device into a form usable by said second display; and communications means for communicably linking said first display and said second display such that subject matter displayed by said first display is also displayed by said second display, and such that subject matter displayed by said second display is also displayed by said first display, said first display and said second display each displaying the opponent's results of the other said arm wrestling device.

2. The arm wrestling device according to claim 1, said first display and said second display each being a video display employing a cathode ray tube.

* * * * *